US005335608A

United States Patent [19]

Dehn et al.

[11] Patent Number: 5,335,608

[45] Date of Patent: Aug. 9, 1994

[54] FURNACE LANCE FOR ATOMIZING A COAL-WATER SUSPENSION

[75] Inventors: Günther Dehn, Wesel; Horst Möllenhoff, Mülheim; Rüdiger Wegelin, Dortmund, all of Fed. Rep. of Germany

[73] Assignee: Deutsche Babcock Energie- und Umwelttechnik AG, Oberhausen, Fed. Rep. of Germany

[21] Appl. No.: 46,210

[22] Filed: Apr. 9, 1993

[30] Foreign Application Priority Data

Apr. 13, 1992 [DE] Fed. Rep. of Germany ..... 4212360

[51] Int. Cl.[5] ..... F23D 1/02

[52] U.S. Cl. ..... 110/264; 239/405; 239/406; 239/600; 239/DIG. 19

[58] Field of Search ..... 110/263, 264, 347; 239/405, 406, 600, DIG. 19

[56] References Cited

U.S. PATENT DOCUMENTS 4,592,506 6/1986 Capes et al. ..... 239/DIG. 19

4,623,906 11/1986 Chandrashekhar et al. .... 239/DIG. 19

4,679,512 7/1987 Skoog ..... 110/347

4,858,538 8/1989 Kuypers et al. ..... 110/264

5,127,346 7/1992 Kepplinger et al. ..... 110/264

5,228,624 7/1993 Mensink ..... 239/405 X

*Primary Examiner*—Edward G. Favors

*Attorney, Agent, or Firm*—Max Fogiel

[57] ABSTRACT

A burner lance for atomizing a suspension of coal in water by means of an atomizing gas. The lance consists of an inner pipe (1) that the suspension flows through, of an outer pipe (2) radially surrounding the inner pipe and leaving a gap (5) that the atomizing gas flows through, and of a nozzle (10) that narrows in the direction the suspension flows in and communicates with both the inner and the outer pipe. The outer pipe extends along the burner beyond the inner pipe and accommodates a nozzle (10) in that section. The outside diameter of the nozzle equals the inside diameter of the outer pipe. The nozzle tapers at a central angle of 35° to 45° and terminates in a concentric exit (11).

6 Claims, 2 Drawing Sheets

FURNACE LANCE FOR ATOMIZING A COAL-WATER SUSPENSION

BACKGROUND OF THE INVENTION

A burner lance for atomizing oil or a suspension of coal dust in liquid is known (EP B 0 172 303). The fuel enters a nozzle at the center, and the gas at the circumference. The head accommodates a series of three mixing sections. The first section is followed by an extremely narrow section that so controls the flow of fuel within the freely flowing gas that the solid particles in the liquid fuel do not to any significant extent come into contact with the metal wall of the blending section and erode it. Downstream of the second section is another section that has several outlet bores and that the fuel and gas are emulsified in.

Another burner lance that atomizes a suspension of coal and water is known from EP A 0 182 545. It has a nozzle accommodated in a pipe. The pipe has bores that deflect and divert fuel flowing through it into a stream that flows forward along its outer circumference. The atomizing gas is also diverted and contacted with the suspension from inside and out. Suspensions of solids in liquid can be deflected and diverted only when the solids are extremely fine.

SUMMARY OF THE INVENTION

The object of the present invention is to improve the generic burner lance to the extent that it will provide simple means of atomizing a thick suspension of coal in water.

The media can be accelerated extensively enough within and around the nozzle in a simple burner lance in accordance with the invention to produce a uniformly atomized suspension. The twist imposed on the atomizing gas just before it contacts the suspension improves the atomization. The nozzle can forward a suspension of comparatively coarse coal particles, measuring up to approximately 6 mm in diameter, in water. The inside diameter of the narrow section depends on the maximal particle size.

The section of pipe in front of the inner pipe prevents the inner pipe from shifting off center due to heat expansion or manufacturing imprecision.

BRIEF DESCRIPTION OF THE DRAWINGS

The invention will now be specified with reference to the drawing, wherein.

DESCRIPTION OF THE PREFERRED EMBODIMENTS

Figure 1:
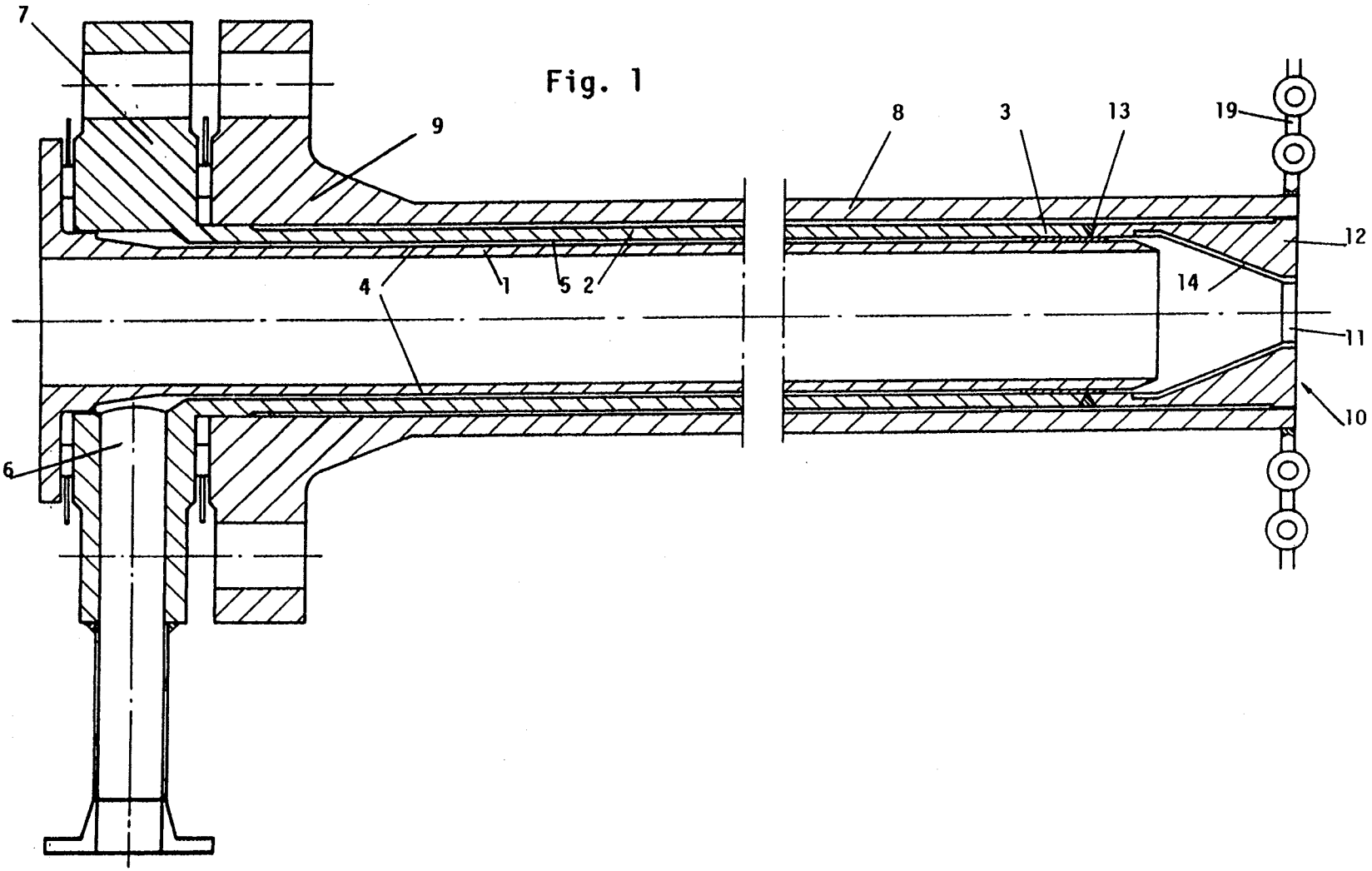
FIG. 1 is a longitudinal section through a burner lance.

The burner lance consists of an inner pipe 1 loosely surrounded by an outer pipe 2. The interval between the pipes is maintained by spacers 3 in the form of strips of sheet metal welded to, or of welding beads on, inner pipe 1. Spacers 3 extend at an angle to the longitudinal axis of inner pipe 1 and spiral around its outer circumference. Spacers 3 simultaneously function as twist-imposition structures. Additional welded-on buildups 4 function as spacers at the rear of inner pipe 1. The result is a cylindrical gap 5 extending over the total length of inner pipe 1 and between it and outer pipe 2. The diameter of gap is much shorter than the inside diameter of inner pipe 1.

Inner pipe 1 communicates with an unillustrated line that forwards fuel in the form of a thick suspension of coal in water into inner pipe 1. Gap 5 extends up to a supply connection 6 in a flange at the rear end of outer pipe 2. An atomizing gas, preferably air, is injected into gap 5 through supply connection 6.

Outer pipe 2 is enclosed over its total length in a positioning pipe 8 that extends directly into a combustion chamber, a fluidized bed for example, surrounded by a cylindrical wall 19. The rear of positioning pipe 8 has a flange 9 that is secured by screws to a flange 7 on outer pipe 2. Outer pipe 2 is narrow and can be extracted from positioning pipe 8 once the flanges have been disconnected.

Positioning pipe 8 is secured to wall 19 by flange 9.

The section of outer pipe 2 that extends along the burner lance and beyond inner pipe 1 accommodates a nozzle 10. The inside of nozzle 10 tapers together from the inside diameter of outer pipe 2, constituting a cone with a central angle of 35 to 45 and preferably 40°. The cone merges into a cylindrical and concentric exit 11 that is preferably at least three times as wide as the largest particle of fuel.

Nozzle 10 can preferably be removed from outer pipe 2 and replaced. The nozzle 10 illustrated in FIG. 1 consists of a metal structure 12 welded at a seam 13 to outer pipe 2. The inner surface of metal structure 12 is provided with an antiwear coating 14.

Figure 2:
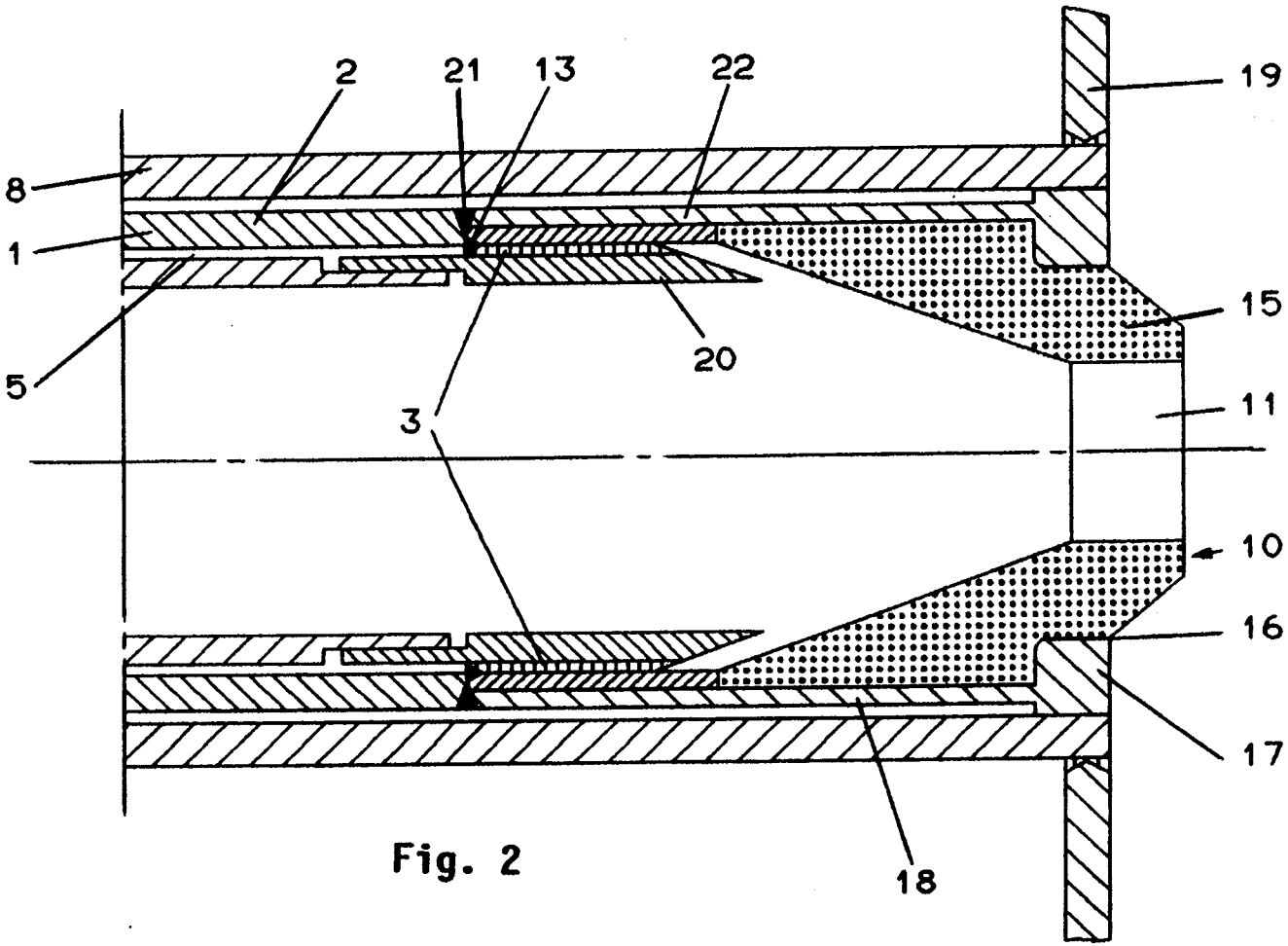
FIG. 2 is a larger-scale longitudinal section through the front of another burner lance.

The nozzle 10 illustrated in FIG. 2 is a ceramic insert 15, preferably of SiC or SiC doped with Si. One face of the ceramic insert 15 in nozzle 10 rests against a shoulder in outer pipe 2 and has a shoulder 16 itself at the exit end. Shoulder 16 is engaged by a projection 17 on a pipe section 18 that is welded at seam 13 to outer pipe 2 at the end facing away from projection 17.

The forward end of inner pipe 1 comprises a pipe section 20. The end of pipe section 20 that faces away from nozzle 10 is narrower and fits into the matching end of inner pipe 1.

Pipe section 20 accordingly rests loose and without packing against inner pipe 1. Spacers 3 in the form of twist-imposing shapes are distributed around the outer circumference of pipe section 20. Spacers 3 are welded by a seam 21 to a sleeve 22 that is welded in turn to pipe section 18 and outer pipe 2 at seam 13. Pipe section 20 can accordingly be applied concentrically to outer pipe 2, with it axial extension keeping it concentric. Any eccentricity would lead to wear on one side of the nozzle.

The atomizing gas flowing through gap 5 accelerates and enters nozzle 10 in a tubular flow, where it encounters the fuel flowing through inner pipe 1. Since the atomizing gas flows through gap 5 at a speed that is appropriate in relation to the speed in the conical section of nozzle 10, the fuel suspension will be satisfactorily atomized. Spacers 3 will impose a twist on the atomizing gas before it impacts the fuel flowing out of exit 11, further improve atomization.

We claim:

1. A burner lance for atomizing a suspension of coal in water by an atomizing gas, comprising: an inner pipe for conducting a suspension flow therethrough; an outer pipe surrounding radially said inner pipe and spaced from said inner pipe by a gap; atomizing gas flowing through said gap; a nozzle communicating with both said inner pipe and said outer pipe and narrowing in direction of flow of said suspension; said outer pipe extending along the burner lance beyond said inner pipe by an extended section and receiving said nozzle in said extended section; said nozzle having an outside diameter equal to an inside diameter of said outer pipe, said nozzle narrowing at a central angel of 35° to 45° and terminating in a central exit opening; and twist-applying means in said gap, said atomizing of said suspension beginning within said nozzle; said inner pipe having a pipe section at the front of said inner pipe and secured to said outer pipe and fitting onto said inner pipe.

2. A burner lance for atomizing a suspension of coal in water by an atomizing gas, comprising: an inner pipe for conducting a suspension flow therethrough; an outer pipe surrounding radially said inner pipe and spaced from said inner pipe by a gap; atomizing gas flowing through said gap; a nozzle communicating with both said inner pipe and said outer pipe and narrowing in direction of flow of said suspension; said outer pipe extending along the burner lance beyond said inner pipe by an extended section and receiving said nozzle in said extended section; said nozzle having an outside diameter equal to an inside diameter of said outer pipe, said nozzle narrowing at a central angle of 35° to 45° and terminating in a central exit opening; and twist-applying means in said gap, said atomizing of said suspension beginning within said nozzle.

3. A burner lance as defined in claim 2, wherein said nozzle is removable from said outer pipe and is replaceable.

4. A burner lance as defined in claim 2, wherein said nozzle is of a ceramic material.

5. A burner lance as defined in claim 2, wherein said nozzle is of metal and has an anti-wear coating.

6. A burner lance for atomizing a suspension of coal in water by an atomizing gas, comprising: an inner pipe for conducting a suspension flow therethrough; an outer pipe surrounding radially said inner pipe and spaced from said inner pipe by a gap; atomizing gas flowing through said gap; a nozzle communicating with both said inner pipe and said outer pipe and narrowing in direction of flow of said suspension; said outer pipe extending along the burner lance beyond said inner pipe by an extended section and receiving said nozzle in said extended section; said nozzle having an outside diameter equal to an inside diameter of said outer pipe, said nozzle narrowing at a central angle of 35° to 45° and terminating in a central exit opening; and twist-applying means in said gap, said atomizing of said suspension beginning within said nozzle; said inner pipe having a pipe section at the front of said inner pipe; said pipe section having an outside circumference receiving said twist-applying means, said pipe section being secured to said outer pipe by said twist-applying means.

* * * * *